United States Patent [19]

Reid

[11] Patent Number: 4,648,885

[45] Date of Patent: Mar. 10, 1987

[54] PROCESS AND COMPOSITION FOR STABILIZED DISTILLATE FUEL OILS

[75] Inventor: Dwight K. Reid, Houston, Tex.

[73] Assignee: Betz Laboratories, Inc., Trevose, Pa.

[21] Appl. No.: 874,259

[22] Filed: Jun. 13, 1986

[51] Int. Cl.[4] ..... C10L 1/22

[52] U.S. Cl. ..... 44/57; 44/63; 44/72

[58] Field of Search ..... 44/57, 63, 72

[56] References Cited

U.S. PATENT DOCUMENTS

| | | | |
|---|---|---|---|
| 2,392,881 | 1/1946 | Rittschof et al. | 44/72 |
| 2,742,349 | 4/1956 | McCoy | 44/63 |
| 3,321,404 | 5/1967 | Furey et al. | 44/71 |
| 3,567,824 | 3/1971 | Moore | 44/63 |
| 4,435,564 | 3/1984 | House | 536/87 |
| 4,440,625 | 4/1984 | Go et al. | 44/72 |
| 4,456,526 | 6/1984 | Miller et al. | 44/72 |
| 4,487,987 | 12/1984 | Paslean et al. | 568/749 |

FOREIGN PATENT DOCUMENTS 2157670 10/1985 United Kingdom .

*Primary Examiner*—Y. Harris Smith

*Attorney, Agent, or Firm*—Alexander D. Ricci; Bruce E. Peacock; James D. Dee

[57] ABSTRACT

This invention relates to processes and compositions for stabilized distillate fuel oils, such as straight-run diesel fuel, which comprise an effective stabilizing amount of (a) N-(2-aminoethyl)piperazine, (b) triethylenetetramine, and (c) N,N-diethylhydroxylamine.

17 Claims, No Drawings

PROCESS AND COMPOSITION FOR STABILIZED DISTILLATE FUEL OILS

BACKGROUND OF THE INVENTION

1. Field of the Invention

This invention relates to stabilized distillate fuel oils. More particularly, this invention relates to inhibiting color deterioration and particulate formation in distillate fuel oils, such as straight-run diesel fuel.

2. Description of the Prior Art

Various middle distillate fuel oils tend, with time, to deteriorate. Normally, distillate fuel oils are stable during standing. However, some distillate fuel oils that contain abnormally high levels of organic acid and sulfur containing species can be quite unstable and may deteriorate. This deterioration usually results in the formation of sediment, sludge, or gum and objectionable color deterioration during transportation and storage. This fuel oil deterioration is caused, in part, by the presence of oxygen in the storage tank containing the fuel oil. Resulting oxidation of the fuel oil manifests itself in the appearance of darker colors, gum and the like. Sediment formation may cause clogging of fuel system equipment such as filters, screens, nozzles, burners and other associated equipment. This problem may be further aggravated when cracked material is blended with distillate fuels. Discoloration of distillate fuel oils is objectionable for various reasons, including customers' preference for light colored fuel oils because discoloration may indicate that deterioration has occurred.

Suggestions of the prior art for stabilizing fuel oils include U.S. Pat. No. 2,672,408, Bonner, which discloses the use of oil-soluble water-insoluble amines, the general formula of which can be represented as: $N(R)_3$, wherein R can be hydrogen or the same or different hydrocarbon radicals with at least one R being a non-aromatic hydrocarbon radical, for protection of particular blends of liquid hydrocarbons against discoloration. Also, U.S. Pat. No. 2,742,349, McCoy, discloses the use of arylamine antioxidants and sundry. substances derived from the class of piperazines for protecting various organic materials from deterioration in the presence of oxygen. U.S. Pat. No. 2,945,749, Andress, discloses the use of a tertiary alkyl, primary, monoamine having from about 4 to 24 carbon atoms and in which the primary nitrogen atom is directly attached to a tertiary carbon atom, for inhibiting fuel oil deterioration in storage. U.S. Pat. No. 3,017,258, Pollitzer, teaches the use of the reaction product of an amine compound, having at least 12 carbon atoms and a straight chain of at least three carbon atoms attached to the nitrogen atom, with an epihalohydrin compound for retarding deterioration of burner oil. U.S. Pat. No. 3,049,414, Kruyff, discloses a process for stabilizing the color of gasoline comprising the steps of washing the gasoline with a liquid characterized as being free of heavy metals and capable of dissolving pyridine; washing with alkaline aqueous solution, characterized as being free of heavy metals; removing substantially all the free alkali; and then adding an organic nitrogenous base, all of whose carbon-carbon bonds are saturated. U.S. Pat. No. 3,129,699, teaches the use of heterocyclic polyamine salts of organic acids to improve the ignition characteristics of diesel fuel. Also, U.S. Pat. No. 3,198,730, Goodrich, discloses the use of a solid sulfuric acid catalyst composition for treatment of catalytically cracked hydrocarbon distillates boiling up to and including the gas oil boiling range.

Additionally, U.S. Pat. No. 3,490,882, Dunworth, relates to stabilized petroleum distillate fuel oils containing N,N-dimethylcyclohexylamine and, optionally, an N,N'-di(orthohydroxyarylidene)-1, 2-alkylenediamine. U.S. Pat. No. 3,640,692, Rakow, et. al., discloses a stabilized distillate hydrocarbon fuel oil composition comprising a major proportion of a distillate hydrocarbon fuel and a minor proportion of a stabilizer comprising (a) an additive selected from the group consisting of (1) an amide plus a Schiff base; (2) an amide containing a Schiff base group; and (3) an amide containing a Schiff base group in combination with either an amide or a Schiff base; and (b) a cyclohexylamine selected from the group consisting of N,N-dimethylcyclohexylamine and dicyclohexylamine. Also, U.S. Pat. No. 3,701,641, discloses a stabilized distillate hydrocarbon fuel oil composition comprising a major proportion of a distillate hydrocarbon fuel and a minor proportion of a stabilizing additive comprised of (a) a polyamine having 2 to about 6 amino groups and containing about 24 to 50 carbons; (b) N,N'-disalicylidine-1,2-propylenediamine, and (c) a cyclohexylamine selected from the group consisting of N,N-dimethylcyclohexylamine and dicyclohexylamine. Of particular interest is U.S. Pat. No. 3,818,006, Klemchuk, which discloses the use of sundry substituted hydroxylamines for stabilizing diverse organic materials against oxidation. Additionally, U.S. Pat. No. 4,509,952, relates to an alkyldimethylamine ranging from $C_4$–$C_{20}$ alkyl which may be added to a distillate fuel as a stabilizer to prevent fuel oil degradation. However, none of these prior art references disclose the unique and effective mixture of N-(2-aminoethyl)piperazine, triethylenetetramine and N,N-diethylhydroxylamine for inhibiting the color degradation and particulate formation of distillate fuel oils.

SUMMARY OF THE INVENTION

This invention relates to processes for stabilizing distillate fuel oil which comprises adding to the distillate fuel oil an effective stabilizing amount of a mixture of (a) N-(2-aminoethyl) piperazine, (b) triethylenetetramine, and (c) N,N-diethylhydroxylamine. This invention also relates to stabilized distillate fuel oil compositions comprising distillate fuel oil and an effective stabilizing amount of (a) N-(2-aminoethyl)piperazine, (b) triethylenetetramine, and (c) N,N-diethylhydroxylamine. More particularly, the processes and compositions of this invention relate to inhibiting particulate formation and color deterioration of distillate fuel oils. Generally, the total amount of the mixture of (a), (b), and (c) is from about 1.0 part to about 10,000 parts per million parts of the fuel oil. It is preferred that the weight ratio of (a):(b) is from about 1:3 to about 3:1, the weight ratio of (a):(c) is from about 1:3 to about 3:1, and the weight ratio of (b):(c) is from about 1:3 to about 3:1. This mixture of (a), (b), and (c) provides an unexpectedly higher degree of stabilization of distillate fuel oils than the individual ingredients comprising the mixture. It is therefore possible to produce a more effective stabilizing composition and process than is obtainable by the use of each ingredient alone. Because of the enhanced stabilizing activity of the mixture, the concentrations of each of the ingredients may be lowered and the total amount of (a), (b), and (c) required for an effective stabilizing treatment may be reduced.

Accordingly, it is an object of the present invention to provide processes and compositions for stabilizing distillate fuel oils. It is another object of this invention to inhibit particulate formation in distillate fuel oils. It is a further object of this invention to inhibit color deterioration of distillate fuel oils. These and other objects and advantages of the present invention will be apparent to those skilled in the art upon reference to the following description of the preferred embodiments.

DESCRIPTION OF THE PREFERRED EMBODIMENTS

The present invention pertains to a process for stabilizing distillate fuel oil, such as straight-run diesel fuel, which comprises adding to the distillate fuel oil an effective stabilizing amount of a mixture of (a) N-(2-aminoethyl)piperazine, (b) triethylenetetramine, and (c) N,N-diethylhydroxylamine. The amounts or concentrations of these three components of this invention can vary depending on, among other things, the tendency of the distillate fuel oil to undergo deterioration or, more specifically, to form particulate matter and/or discolor. While from the disclosure of this invention it would be within the capability of those skilled in the art to find by simple experimentation the optimum amounts or concentrations of (a), (b), and (c) for any particular distillate fuel oil, generally the total amount of the mixture of (a), (b), and (c) which is added to the distillate fuel oil is from about 1.0 part to about 10,000 parts per million parts of the distillate fuel oil. Preferably, the mixture of (a), (b), and (c) is added in an amount from about 1.0 part to about 1,500 parts per million. It is also preferred that the weight ratios of: (a):(b) is from about 1:3 to about 3:1; (a):(c) is from about 1:3 to about 3:1; and (b):(c) is from about 1:3 to about 3:1, based on the total combined weight of these three components. Most preferably, the weight ratio of (a):(b):(c) is about 2:1.5:1.5 based on the total combined weight ratio of these three components.

The aforementioned three components, (a), (b), and (c), are all presently available commercially. The components can be added to the distillate fuel oil by any conventional method. The three components can be added to the distillate fuel oil as a single mixture containing all three compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to stabilize the distillate fuel oil during storage.

The present invention also pertains to a stabilized distillate fuel oil composition comprising a major portion of distillate fuel oil, such as straight-run diesel fuel, and a minor portion of an effective stabilizing amount of (a) N-(2-aminoethyl) piperazine, (b) triethylenetetramine, and (c) N,N-diethylhydroxylamine. Generally, the total amount of (a), (b), and (c) is from about 1.0 part to about 10,000 parts per million parts of the distillate fuel oil and, preferably, the total amount of (a), (b), and (c) is from about 1.0 part to about 1,500 parts per million parts of the distillate fuel oil. It is also preferred that the weight ratios of: (a):(b) is from about 1:3 to about 3:1; (a):(c) is from about 1:3 to about 3:1; and (b):(c) is from about 1:3 to about 3:1, based on the total combined weight of these three components and, most preferably, the weight ratio of (a):(b):(c) is about 2:1.5:1.5 based on the total combined weight of these three components.

The distillate fuel oils of this invention are those fuels produced by distillation of fuel oils, such as straight-run diesel fuel, as distinguished from fuel products produced by cracking or reforming processes. More particularly, the distillate fuel oils of this invention are those fuel oils having hydrocarbon components distilling from about 300° F. to about 700° F., such as kerosene, jet fuel and diesel fuel. Preferably, the distillate fuel oil is straight-run diesel fuel.

The processes and compositions of the instant invention effectively stabilize the distillate fuel oils, particularly during storage. The term "stabilize" as used herein means that particulate formation in the distillate fuel oil and color deterioration of the distillate fuel oil are inhibited. The term "particulate formation" is meant to include the formation of soluble solids, sediment and gum.

In order to more clearly illustrate this invention, the data set forth below was developed. The following examples are included as being illustrations of the invention and should not be construed as limiting the scope thereof.

EXAMPLES

There are several accelerated test methods that are used by refineries for determining the stability of diesel fuels. Some of the most widely accepted test methods are the 110° F. dark storage test (one week to three months), DuPont F21-61, UOP test method 413, 80° C. test, ASTM D-2274 test, and the 216° F. test. It was observed that some diesel fuels respond positively to selected chemical additives under specific conditions. In some cases, additives that were effective under accelerated test conditions (e.g., 216° F., 300° F.), were occasionally found to perform poorly under the more moderate 110° F. test. This observation agrees with those found in the recent literature. See Stavinoha, L. L., et. al., "*Accelerated Stability Test Techniques for Diesel Fuels,*" October, 1980. Stability data obtained using the 216° F. or 300° F. accelerated tests are considered to be only qualitative indicators of the performance expectations of an additive under the highly regarded 110° F. storage test condition. It is widely accepted among researchers that seven days at 110° F. is equivalent to one month's storage at 72° F. Although the results of the 110° F. dark storage test are generally accepted as the only valid data in correlating data from these conditions to those from actual storage, some current manufacturers continue to rely on stability data from the more accelerated conditions.

The effect of the components to inhibit color degradation of a straight-run diesel fuel derived from a 50% San Joaquin Valley crude and 50% North Alaska crude was tested using the conditions of the 216° F. accelerated test method. Four-ounce glass bottles were filled with 100 mLs of the diesel fuel. The samples were then spiked with the appropriate treatments. The glass bottles were capped but not tightly sealed to allow for the samples to be exposed to air during the test. The bottles were then transferred to an oil bath whose temperature was maintained at 216° F.±2° F. during the duration of the test. The oil temperature recovered to 216°±2° F. within 15 minutes after the samples were placed in oil. The bath oil level covered at least three-fourths of the sample. The test was allowed to run for the time periods specified below. The samples were then removed and stored in the dark for two hours. The color of the samples was determined by visual comparison with known standards according to the ASTM-D-1500 procedure, which involved matching the color of the fuel samples with ASTM-1500 color numbers. The results are based on a scale of 0.5 to 8.0 wherein increasing values indicate increasing darkness of the sample. The results obtained are reported in Table I below.

TABLE I

| | TETA[1] | DEHA[2] | AEP[3] | ASTM COLOR # a | ASTM COLOR # b |
|---|---|---|---|---|---|
| CONC. | — | — | — | 3.4[4] | 3.8[4] |
| ACTIVE | 150 | 150 | 200 | 1.5 | |
| PPM | 75 | 75 | 100 | 1.8 | |
| | 100 | 100 | 300 | 1.8 | |
| | 75 | 75 | 150 | 2.5 | |
| | 250 | 250 | | 1.5 | 1.8 |
| | 125 | 125 | | 2.0 | 2.5 |
| | | 250 | 250 | 1.7 | |
| | | 125 | 125 | 2.3 | |
| | 166.6 | 166.6 | 166.6 | 2.0 | |
| | 83.3 | 83.3 | 83.3 | 2.3 | |

ASTM Color:
[a]2½ hours at 216° F.
[b]2½ hours at 216° F. plus 24 hours at 72° F.
[1]Triethylenetetramine
[2]N,N—diethylhydroxylamine
[3]N—(2-aminoethyl)piperazine
[4]Control-untreated sample The results reported in Table I indicate that the combination of the three components of this invention, N-(2-aminoethyl)piperazine (AEP), triethylenetetramine (TETA), and N,N-diethylhydroxylamine (DEHA), is effective in inhibiting color deterioration of the straight-run diesel fuel.

Additional tests were conducted to determine the effect of the components and their concentration to inhibit both discoloration and solids formation of a straight-run diesel fuel derived from 50% San Joaquin Valley crude and 50% North Alaska crude using the 110° F. dark storage test. 100 mLs of the diesel fuel were transferred into glass bottles. Caps were secured on the bottled samples but not tightly in order to expose the fuel to atmospheric conditions. The samples were placed in an oven set at 110° F. for 14 days. The samples were then removed from the oven and allowed to cool to room temperature. After each sample had cooled, it was poured into a separatory funnel and filtered (dispersed) through a tared Gooch crucible containing two glass-fiber filter papers. The ASTM-D-1500 procedure was used to determine the color of the filtrant. The sample container was washed with the rinsings (about 50 mL) of a heptane/acetone solvent (50/50). The separatory funnel and filter washing were also worked through the crucible. The crucible was dried in an oven (100° C.) for one hour, cooled in a dessicator and the precipitate was weighed. The results obtained are reported in Table II below.

TABLE II

| Concentration Level of Active Agent (ppm) AEP[1] | TETA[2] | DEHA[3] | Other | Color Level of Diesel Fuel[4] ASTM Color Number | Quantity of Precipitate (mg/50 mLs) |
|---|---|---|---|---|---|
| — | — | — | Blank | 6.0 | 52.4 |
| — | — | — | Blank | 6.0 | 50.7 |
| — | — | — | Blank[5] | 6.0 | 126.5 |
| 400 | 300 | 300 | | 2.5 | 31.2 |
| 200 | 150 | 150 | 6 | 3.7 | 87.4 |
| 200 | 150 | 150 | 5 | 3.7 | 108 |
| 200 | — | — | — | 5.0 | 16.3 |

TABLE II-continued

| Concentration Level of Active Agent (ppm) AEP[1] | TETA[2] | DEHA[3] | Other | Color Level of Diesel Fuel[4] ASTM Color Number | Quantity of Precipitate (mg/50 mLs) |
|---|---|---|---|---|---|
| — | 150 | — | — | 6.0 | 37.2 |
| — | 150 | — | 7 | 6.0 | 25.1 |
| — | — | 150 | — | 4.3 | 42.0 |
| — | — | 300 | — | 4.3 | 43.2 |
| 200 | 150 | — | — | 5.6 | 32.3 |
| 200 | — | 150 | — | 3.7 | 41.8 |
| 200 | — | 300 | — | 2.5 | 58.3 |
| — | 150 | 150 | — | 5.0 | 33.8 |
| — | 150 | 300 | — | 2.8 | 41.0 |

[1]N—(2-aminoethyl)piperazine
[2]Triethylenetetramine
[3]N,N—diethylhydroxylamine
[4]Determined after 14 days at 110° F. in an ambient atmosphere.
[5]Sample exposed to air after 1, 7 and 14 days; after each exposure, filtrations were performed. These filtrations yielded a combined weight of precipitate.
[6]Sample exposed to air after 7 and 14 days; after each exposure, filtrations were performed. These filtrations yielded a combined weight of precipitate.
[7]A second sample was prepared and examined after 13 days of heated storage.

The results reported in Table II demonstrate the unique and exceptionally effective relationship of the components of this invention since the samples containing N-(2-aminoethyl)piperazine, triethylenetetramine and N,N-diethylhydroxylamine show better overall effectiveness in stabilizing the diesel fuel (inhibiting both color degradation and solids formation) than was obtainable in using each of the components individually.

Further tests were conducted to determine the effect of the components of this invention to inhibit both color deterioration and sediment formation of the straight-run diesel fuel described above using the 110° F. dark storage test for a seven day test period. The results obtained are reported in Table III below.

TABLE III

| Treatment | Quantity of Sediment (mg/100 mLs) | ASTM Color Number |
|---|---|---|
| Control Avg. | 6.6 | 4.3 |
| A | 0.4 | 3.5 |
| B | 1.0 | 2.5 |

A = UOP-130; a dispersant material manufactured by UOP of Des Plaines, IL, which is believed to be the reaction product of a tallowamine with epichlorohydrin.
B = N—(2-aminoethyl)piperazine:triethylenetetramine;N,N—diethyl-hydroxylamine (2:1.5:1.5)

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for stabilizing distillate fuel oil which comprises adding to said fuel oil an effective stabilizing amount of a mixture of (a) N-(2-aminoethyl)piperazine, (b) triethylenetetramine, and (c) N,N-diethylhydroxylamine.

2. The process of claim 1 wherein said mixture is added in an amount from about 1.0 part to about 10,000 parts per million parts of said fuel oil.

3. The process of claim 1 wherein said mixture is added at ambient temperature and pressure.

4. The process of claim 1 wherein the weight ratios of: (a):(b) is from about 1:3 to about 3:1, (a):(c) is from about 1:3 to about 3:1, and (b):(c) is from about 1:3 to about 3:1.

5. The process of claim 4 wherein the weight ratio of (a):(b):(c) is about 2:1.5:1.5.

6. The process of claim 4 or 5 wherein said mixture is added in an amount from about 1.0 part to about 1,500 parts per million parts of said fuel oil.

7. A process for inhibiting particulate formation and color deterioration of straight-run diesel fuel which comprises adding to said diesel fuel an effective amount of a mixture of (a) N-(2-aminoethyl)piperazine, (b) triethylenetetramine, and (c) N,N-diethylhydroxylamine, wherein the weight ratio of (a):(b) is from about 1:3 to about 3:1, the weight ratio of (a):(c) is from about 1:3 to about 3:1, and the weight ratio of (b):(c) is from about 1:3 to about 3:1.

8. The process of claim 7 wherein said mixture is added in an amount from about 1.0 part to about 10,000 parts per million parts of said diesel fuel.

9. The process of claim 7 wherein said mixture is added at ambient temperature and pressure.

10. The process of claim 7 wherein the weight ratio of (a):(b):(c) is about 2:1.5:1.5.

11. The process of claim 8 or 10 wherein said mixture is added in an amount from about 1.0 part to about 1,500 parts per million parts of said diesel fuel.

12. A stabilized distillate fuel oil composition comprising distillate fuel oil and an effective stabilizing amount of (a) N-(2-aminoethyl)piperazine, (b) triethylenetetramine, and (c) N,N-diethylhydroxylamine.

13. The composition of claim 12 wherein the total amount of (a), (b), and (c) is from about 1.0 part to about 10,000 parts per million parts of said fuel oil.

14. The composition of claim 12 wherein the weight ratios of: (a):(b) is from about 1:3 to about 3:1, (a):(c) is from about 1:3 to about 3:1, and (b):(c) is from about 1:3 to about 3:1.

15. The composition of claim 14 wherein the distillate fuel oil is straight-run diesel fuel.

16. The composition of claim 15 wherein the weight ratio of (a):(b):(c) is about 2:1.5:1.5.

17. The composition of claim 15 or 16 wherein the total amount of (a), (b), and (c) is from about 1.0 part to about 1,500 parts per million parts of said diesel fuel.

* * * * *